United States Patent [19]

Kumar et al.

[11] 4,394,629

[45] Jul. 19, 1983

[54] HYBRID POWER DIVIDER/COMBINER CIRCUIT

[75] Inventors: Mahesh Kumar, South Brunswick; Raymond J. Menna, Plainsboro; Ho-Chung Huang, West Windsor, all of N.J.

[73] Assignee: RCA Corporation, New York, N.Y.

[21] Appl. No.: 249,609

[22] Filed: Mar. 31, 1981

[51] Int. Cl.[3] ..... H01P 5/18

[52] U.S. Cl. ..... 333/109; 333/116

[58] Field of Search ..... 333/109, 112, 115, 116, 333/156, 161

[56] References Cited

U.S. PATENT DOCUMENTS

| | | | |
|---|---|---|---|
| 3,423,688 | 1/1969 | Seidel | 330/53 |
| 3,748,601 | 7/1973 | Seidel | 333/109 |
| 4,281,293 | 7/1981 | Childs et al. | 333/116 X |
| 4,323,863 | 4/1982 | Weber | 333/109 |

*Primary Examiner*—Paul L. Gensler

*Attorney, Agent, or Firm*—J. S. Tripoli; R. L. Troike; R. E. Smiley

[57] ABSTRACT

A 0° and 180° hybrid power divider/combiner includes a first quadrature hybrid and two other quadrature hybrids arranged in tandem with one output port of the first hybrid connected to an input port of the tandem arrangement and the other output port thereof connected to a delay of electrical length equal to that of the tandem arrangement. When an input signal is applied to one input port of the first hybrid with the other port terminated, two signals of reduced amplitude which are either in phase or of opposed phase (dependent on which input port receives the input signal) are produced at the output of the tandem arrangement and delay.

6 Claims, 2 Drawing Figures

HYBRID POWER DIVIDER/COMBINER CIRCUIT

Figure 1:
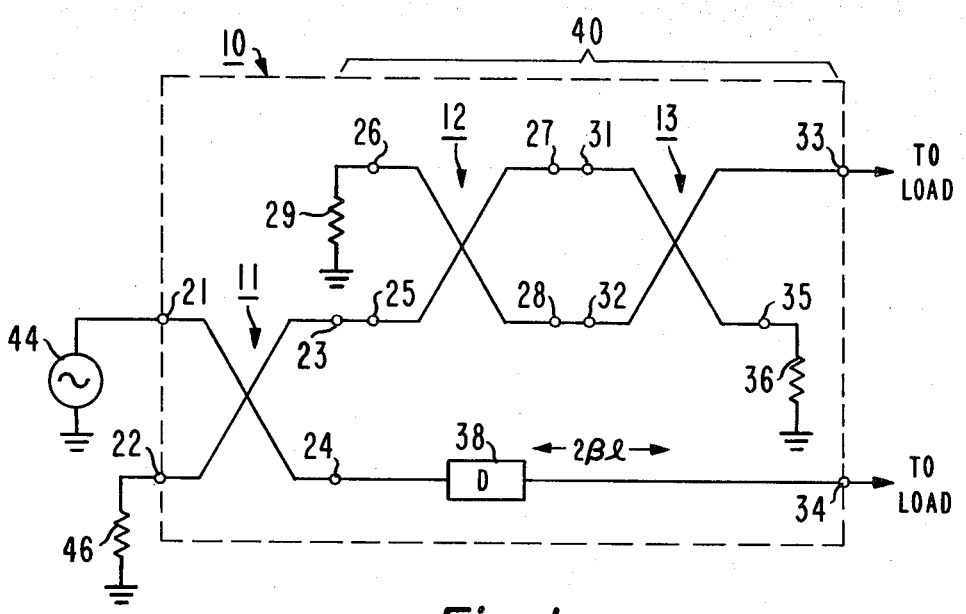

The Government has rights in this invention pursuant to Contract No. N00014-79-C-0568 awarded by the Department of the Navy.

This invention relates to hybrid power divider/combiner circuits and more particularly, to such circuits which produce output signals 180° out of phase. 180° hybrid circuits are ideal for use as power dividers, combiners, balanced mixers, image rejection mixers, antenna feed networks, matrix amplifiers, switching networks and phase shifters.

There are a number of devices presently available for use as 180° power dividers. A hybrid ring is of relatively narrow band and of relatively large physical size. A strip transmission line 180° power divider such as the Model No. 4343 sold by Narda Microwave Corp. Plainview, N.Y. 11803, is of relatively narrow band if only a single device is used and relatively physically long if several sections are combined to achieve a broad band characteristic. U.S. Pat. No. 3,423,688, especially in FIG. 4, illustrates a 180° power divider shifting circuit comprised of an inphase hybrid and only two quadrature hybrids, one terminated in a short circuit and one terminated in an open circuit. For such a circuit to exhibit exactly 180° phase shift between output signals it is essential that a perfect open circuit and perfect short circuit be attained which, in practice, is not possible.

The present invention involves quadrature hybrids. In general, a hybrid or hybrid junction is a four branch or four port power dividing network in which the branches are arranged in pairs, with the branches comprising each pair being conjugate to each other and in coupling relationship with the branches of the other of said pairs. The power division ratio of a hybrid junction is a matter of design. However as commonly used, the term generally refers to a 3 dB power divider in which the incident power of a signal to one branch of one pair of conjugate branches divides equally between the other pair of conjugate branches. Hybrid junctions can be further divided into two general classes. In one class the output power divided signals are either in phase, or 180° out of phase. The second class of hybrid junctions are quadrature phase shift devices in which the output power divided signals differ by 90°.

In accordance with a preferred embodiment of the present invention, first, second and third quadrature hybrids, each having a pair of input ports and a pair of output ports with the output ports of the second hybrid connected in tandem to the input ports of the third hybrid. One output port of the first hybrid is connected to an input port of the second hybrid while the other output port of the first hybrid is connected to a delay means of electrical length the same as that of the second and third hybrids.

Figure 2:
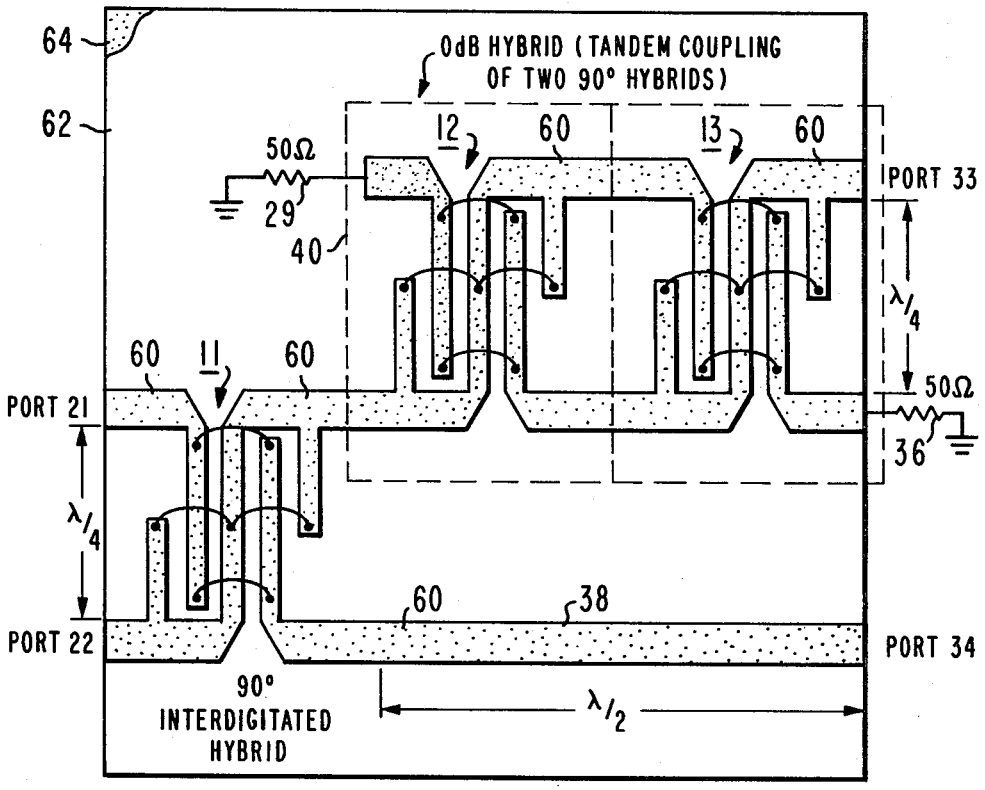

In the drawing:

FIG. 1 is an electrical schematic illustration of a 180° power divider combiner in accordance with the invention; and FIG. 2 is a top plan view of the 180° power divider of FIG. 1 using microstrip transmission line.

In FIG. 1, first, second and third quadrature hybrids 11, 12 and 13 of a 180°/0° hybrid power divider/combiner circuit 10 are illustrated in electrical schematic form. Hybrid 11 has two input ports or terminals 21 and 22 and two output ports or terminals 23 and 24. Hybrids 12 and 13 are similarly configured. In general, if an alternating signal of a given amplitude is applied at either input port while the other input port is match terminated (a resistor connected to circuit ground which is of resistive value equal to the characteristic impedance of hybrid 11) the signal appearing at ports 23 and 24 are 90° out of phase and of relative magnitude determined by the coupling coefficient of the hybrid. In a conventional 3 dB hybrid the output amplitudes are identical and equal to half of the amplitude of the input signal.

Port 23 is connected to input port 25 of hybrid 12 while the other input port 26 thereof is match terminated by a resistor 29. Output port 27 and 28 of hybrid 12 are connected in tandem to the input ports 31 and 32 of quadrature hybrid 13. Output port 33 thereof is connected to a suitable load, not illustrated. Port 35, which is directly connected to port 23 of hybrid 11, is match terminated by resistor 36. Quadrature hybrids 12 and 13 need not be 3-dB hybrids but must have identical power dividing ratios which need not be the same as that of hybrid 11. Hybrids 12 and 13 taken together are termed a 0-dB tandem hybrid 40. All hybrids cause an electrical delay to the passage of signals therethrough. To compensate for this delay encountered in the signal passing through hybrids 12 and 13 a delay 38 is inserted between output port 24 of hybrid 11 and output port 34 of circuit 10. The electrical delay from port 24 to port 34 is just equal to that in hybrids 12 and 13 combined.

Although the hybrids 11, 12 and 13 may be of any type, interdigitated type hybrids are particularly advantageous because they may easily be made broad band and they may be constructed in microstrip form to thus provide for a very compact 180°/0° power divider.

FIG. 2 to which attention is now directed illustrates the power divider of FIG. 1 in microstrip form. Interdigitated hybrids and other components corresponding to those in FIG. 1 are correspondingly legended. The power divider of FIG. 2 achieves an octave bandwidth. All components such as the narrow stripline conductors 60 may, by way of example, be fabricated on an alumina or GaAs substrate 62 (not shown) and are compatible for monolithic integration with active devices, like FET's and other passive circuits on a GaAs substrate. A ground planar conductor 64 is on the opposite side. A portion of the substrate 62 is shown broken away in FIG. 2 to illustrate the ground planar conductor.

A non-mathematical description of the operation of power divider 10 with the assumption that all hybrids are of the 3-dB type follows. If a unit amplitude signal produced by a source 44 is applied at port 21 while port 22 is match terminated by resistor 46, signals 180° out of phase and of equal one half amplitude values (or other ratios determined by the coupling coefficients of the various hybrids) are produced at ports 33 and 34. If a unit amplitude signal produced by source 44 is applied to port 22 while port 21 is match terminated by resistor 46 (the reverse of the situation illustrated in FIG. 1) two in phase half amplitude signals are produced at ports 33 and 34. Further, if two 180° out of phase signals of equal amplitude are applied at ports 33 and 34 with port 22 match terminated at illustrated, a combined double amplitude signal appears at port 21. Also if two equal amplitude in phase signals are applied at ports 33 and 34 with port 21 match terminated, a combined double amplitude signal appears at port 22.

A mathematical treatment of power divider/combiner 10 with the assumption that all hybrids are of the 3 dB type is as follows. Assuming that conditions are as illustrated in FIG. 1 with source 44 producing a unit amplitude signal $$\text{Signal at port 23} = j \sin \theta e^{-j\beta l} \quad (1)$$

$$\text{Signal at port 24} = \cos \theta e^{-j\beta l} \quad (2)$$

where $\theta$ is the coupling angle, l is the coupling length and $\beta$ is the propagation constant. If the signal is applied to port 22 when port 21 is match terminated, the signal at ports 23 and 24 are given by equations (2) and (1), respectively.

Assuming a signal of unit amplitude is applied at port 25 with port 26 match terminated and with resistor 36 not present $$\text{Signal at port 33} = j \sin 2\theta e^{-j2\beta l} \quad (3)$$

$$\text{Signal at port 35} = \cos 2\theta e^{-j2\beta l} \quad (4)$$

If the unit amplitude signal is applied to port 26 while port 25 is match terminated, the signal at ports 33 and 35 is given by equations (4) and (3), respectively.

Assume now that a unit amplitude signal is applied at port 21 while port 22 is match terminated and the length of delay from port 24 to port 34 is equal to $2\beta l$, then combining equations (1)–(4):

$$\text{Signal at port 33, } V_3 = \sin \theta \sin 2\theta e^{-j3\beta l} \quad (5)$$

$$\text{Signal at port 34, } V_4 = \cos \theta e^{-j3\beta l} \quad (6)$$

$$\text{Signal at port 35, } V_I = j \sin \theta \cos 2\theta e^{-j3\beta l} \quad (7)$$

For a 3 dB hybrid $\theta = \pi/4$, which when substituted into equations (5)–(7) results in the following equations:

$$V_3 = -0.707 e^{-j3\beta l} \quad (8)$$

$$V_4 = 0.707 e^{-j3\beta l} \quad (9)$$

$$V_I = 0 \quad (10)$$

Thus, the signals appearing at ports 33 and 34 have a phase difference of 180° and are equal in magnitude, which is $\sqrt{2}$ below the input signal (3 dB below in power). Port 35 is an isolated port since the signal appearing at port 35 is 0.

With a unit amplitude signal applied at port 22 while port 21 is match terminated and again utilizing equations (1)–(4):

$$\text{Signal at port 33, } V_3 = j \cos \theta \sin 2\theta e^{-j3\beta l} \quad (11)$$

$$\text{Signal at port 34, } V_4 = j \sin \theta e^{-j3\beta l} \quad (12)$$

$$\text{Signal at port 35, } V_I = \cos \theta \cos 2\theta e^{-j3\beta l} \quad (13)$$

For $\theta = \pi/4$, for a 3-dB hybrid, substituted in equations (11)–(13) the following equations are obtained:

$$V_3 = j0.707 e^{-j3\beta l} \quad (14)$$

$$V_4 = j0.707 e^{-j3\beta l} \quad (15)$$

$$V_I = 0 \quad (16)$$

Thus, signals appearing at ports 33 and 34 are in phase having equal amplitudes each 3 dB below the input power. Port 35 is an isolated port and is match terminated.

In both the 180° phase shift example and the 0° phase shift example the phase difference between the two output ports 33 and 34 is independent of frequency. However, the amplitude is frequency dependent. The bandwidth of power divider/combiner 10 will be slightly less than the bandwidth of each 90° hybrid used. A 90° interdigitated hybrid has over an octave bandwidth. Therefore a power divider/combiner constructed in accordance with the teachings of the invention and having an octave bandwidth is feasible.

What is claimed is:

1. A power divider comprising in combination:

first, second and third quadrature hybrids, each having a pair of input ports and a pair of output ports, one of said output ports of said first hybrid being connected to one of said input ports of said second hybrid, said output ports of said second hybrid being directly connected to the input ports of said third hybrid for causing a signal passing through the combination of said second and third hybrids to exhibit a propagation delay L and a fixed relative to frequency 90° phase shift; and a transmission line exhibiting a propagation delay L having no fixed relative to frequency phase shift coupled to the other output port of said first hybrid.

2. The combination as set forth in claim 1 further including means for match terminating the other of said second hybrid input ports and means for match terminating one of the output ports of said third hybrid.

3. The combination as set forth in claim 1 further including means for match terminating the other of said input ports of said second hybrid and means for match terminating the one of said third hybrid output ports which is directly coupled to an output port of said first hybrid.

4. The combination as set forth in any of claim 1 or claim 2 or claim 3 wherein said hybrids are interdigitated hybrids.

5. The combination as set forth in any of claim 1 or claim 2 or claim 3 wherein said hybrids are microstrip interdigitated hybrids.

6. The combination as set forth in either claim 2 or claim 3 further including means for match terminating one of said first hybrid input ports.

* * * * *